US005084238A

United States Patent [19]

Masuyama et al.

[11] Patent Number: 5,084,238

[45] Date of Patent: Jan. 28, 1992

[54] HIGH STRENGTH HEAT-RESISTANT LOW ALLOY STEELS

[75] Inventors: Fujimitsu Masuyama; Humio Mitsuura, both of Nagasaki, Japan

[73] Assignee: Mitsubishi Jukogyo Kabushiki Kaisha, Tokyo, Japan

[21] Appl. No.: 559,945

[22] Filed: Jul. 31, 1990

[30] Foreign Application Priority Data

Jul. 31, 1989 [JP] Japan ..... 1-196936
Aug. 30, 1989 [JP] Japan ..... 1-221698

[51] Int. Cl.[5] ..... C22C 38/44

[52] U.S. Cl. ..... 420/109; 420/105; 420/111; 148/335; 148/334

[58] Field of Search ..... 420/105, 106, 109, 111, 420/113; 148/335, 334

[56] References Cited

U.S. PATENT DOCUMENTS 2,968,549 1/1961 Brady et al. ..... 420/109

FOREIGN PATENT DOCUMENTS 95362 9/1970 France ..... 148/334

*Primary Examiner*—Deborah Yee

*Attorney, Agent, or Firm*—Fleit, Jacobson, Cohn, Price, Holman & Stern

[57] ABSTRACT

High strength heat-resistant low alloy steels have a chemical composition of, on weight basis, a carbon content of 0.03–0.12%, a silicon content not higher than 1%, a manganese content of 0.2–1%, a phosphor content not higher than 0.03%, a sulfur content not higher than 0.03%, a nickel content not higher than 0.8%, a chromium content of 0.7–3%, a molybdenum content of 0.3–0.7%, a tungsten content of 0.6–2.4%, a vanadium content of 0.05–0.35%, a niobium content of 0.01–0.12% and a nitrogen content being 0.01–0.05% with the balance of iron and inevitable impurities, wherein the molybdenum content and the tungsten content satisfy the relationship $0.8\% \leqq (Mo+\frac{1}{2}W)\% \leqq 1.5\%$; or a carbon content of 0.03–0.12%, a silicon content not higher than 1%, a manganese content of 0.2–1%, a phosphor content not higher than 0.03%, a sulfur content not higher than 0.03%, a nickel content not higher than 0.8%, a chromium content of 0.7–3%, a molybdenum content of 0.3–1.5%, a vanadium content of 0.05–0.35%, a niobium content of 0.01–0.12%, a nitrogen content of 0.01–0.05% and, occasionally, a further content of one or more of tungsten, in a content of 0.5–2.4%, boron, in a content of 0.0005–0.015%, aluminum, in a content not higher than 0.05%, and titanium, in a content of 0.05–0.2%, with the balance of being iron and inevitable impurities. The low alloy steels are obtained by subjecting a starting metal having the above chemical composition to a heat treatment by heating it to a temperature above 1100° C. (A) and subsequent cooling to the ordinary temperature, then, subjecting the so treated metal to a plastic working at a temperature in the range from the ordinary temperature to a temperature at which no recrystallization occurs during the working or in the course of subsequent cooling and, finally, subjecting the so worked metal to a normalizing at a temperature lower than 1100° C. (A) and to a tempering at a temperature below the $Ac_1$ point.

2 Claims, 5 Drawing Sheets

HIGH STRENGTH HEAT-RESISTANT LOW ALLOY STEELS

BACKGROUND OF THE INVENTION

The present invention relates to high strength heat resistant low alloy steels adapted to use for the material for, such as, power plant boilers, heat exchangers and pipes in chemical plants, forged and cast steel products, such as, high temperature pressure valves etc., various steel half-products, such as, round steels, profiles, slabs and plates for products of manufacture for high temperature uses, such as, hooks, suspensions, tensile members, support members, etc.

Heretofore, various heat-resistant steels have been in practical uses, including austenitic stainless steels, 9% chromioum steels, 12% chromium steels, 1–2¼% chromium steels and low chromium steels of less than 1% chromium.

In these conventional heat-resistant steels, problems are left unsolved in using them at high temperatures up to about 600° C., such as follows:

(1) Austenitic steels:

While these steels exhibit in general better performances as to the high temperature strength, toughness and workability, they tend to suffer from stress corrosion cracking and grain boundary corrosion in certain application conditions. Their higher prices may be accounted as an additional disadvantage.

(2) 9% and 12% chromium steels:

Among them, STBA 26 (9% chromium 1% molybdenum steel) and X20CrMoV 121 (12% chromium 1% molybdenum vanadium steel) of DIN standard have a higher carbon content of about 0.13–0.25% by weight and, hence, are apt to suffer from occurrence of weld crack and exhibit poor workability. In the recently developed low carbon steels having contents of V and Nb, weldability and high temperature strength are improved as compared with the high carbon steels mentioned above. They exhibit, however, lower heat conductance and are, in general, poor in workability upon welding.

(3) 1%–2¼% chromium steels:

These steels have better resistance against oxidation, permitting their use at temperatures up to about 600° C. They are most excellent in high-temperature strength over the low alloy steels inclusive of STBA 26 and are better also in weldability and workability. However, the high-temperature strength of these alloys does not surpass those recently developed high strength steels of 9% chromium steels, of 12% chromium steels and of austenitic stainless steels. Thus, it is necessary to design various parts to be employed at about 600° C. with considerable thicknesses, so that it is unavoidable to endure occurrence of large thermal stress in large diameter pipes in, for example, high-temperature pipe lines etc.

(4) Low alloy steels having chromium content less than 1.0%:

They reveal lower high-temperature strength and are poor in resistance against oxidation as compared with those of 1%–2¼% chromium steels, so that they possess lower maximum operable temperatures.

In steels, in which a small amount of V or Nb is contained in order to improve the high-temperature strength, local portions having finely dispersed microstructure due to recrystallization caused by a possible welding heat or so on exhibit decreased hardness as compared with the original material. When testing a test specimen having such a local low hardness portion on a creep rupture testing machine or on a tension tester, it will be broken at such a portion and shows a lower strength value than the original material.

Low carbon steels of 1%–2¼% Cr having contents of Mo, W, V and Nb have a large proportion of ferritic phase and exhibit lower toughness.

BRIEF SUMMARY OF THE INVENTION

An object of the present invention is to provide low alloy steels in which the disadvantages of the conventional low alloy steels explained above are eliminated.

Another object of the present invention is to provide low alloy steels of lower price capable of being employed for applications for use at temperatures up to about 600° C., in which the high-temperature strength is improved considerably as compared with that of the conventional low alloy steels of 1%–2¼% Cr and which can be employed even in the place of 9% Cr or 12% Cr high strength steels or austenitic stainless steels at high temperatures up to about 600° C.

A further object of the present invention is to provide low alloy steels in which occurrence of portions of decreased hardness at around welded portion is minimized and the Charpy impact value of the matrix metal is improved.

In some steels based on 1%–2¼% Cr, a considerable improvement in the high-temperature strength may be possible when incorporating therein additional contents of Mo, W, V and Nb, as in the case of the steels according to the present invention. However, the creep rupture strength for longer creep rupture time of such alloy steels may not be sufficient in accordance with the content of Mo and W. Therefore, it is contemplated by the present invention to provide, in particular, low alloy steels exhibiting high creep rupture strengths stable for longer creep rupture times (over $10^4$ hours) of at least 13 kgf/mm$^2$ at 600° C. at $10^4$ hours.

BRIEF DESCRIPTION OF THE DRAWINGS

The invention will now be described in detail with reference to the accompanying drawings wherein.

DETAILED DESCRIPTION OF PREFERRED EMBODIMENTS

Figure 1:
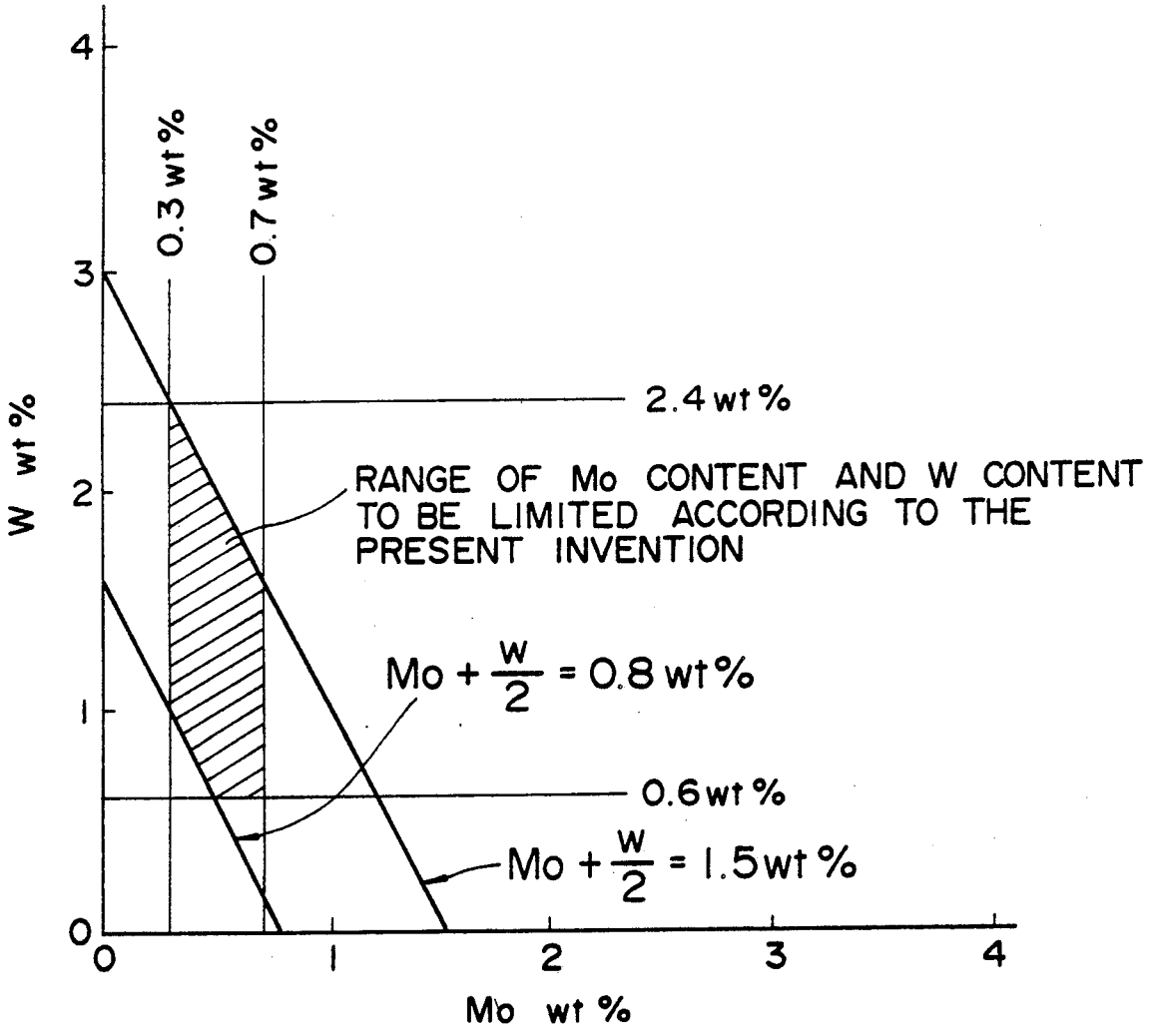
FIG. 1 shows the range of allowable contents of W and Mo (hatched area) in the low alloy steels according to the first aspect of the present invention in a graphic illustration.

The present invention concerns itself, in the first aspect thereof, with high strength heat-resistant low alloy steels having a chemical composition of, on the weight basis, (all % are hereinafter intended to mean wt. % unless otherwise designated) a carbon content of 0.03–0.12%, a silicon content not higher than 1%, a manganese content of 0.2–1%, a phosphor content not higher than 0.03%, a sulfur content not higher than 0.03%, a nickel content not higher than 0.8%, a chromium content of 0.7–3%, a molybdenum content of 0.3–0.7%, a wolfram (tungsten) content of 0.6–2.4%, a vanadium content of 0.05–0.35%, a niobium content of 0.01–0.12% and a nitrogen content of 0.01–0.05% with the balance of iron and inevitable impurities, wherein the molybdenum content and the wolfram tungsten content satisfy the relationship:

$$0.8\% \leqq (Mo + \tfrac{1}{2} W)\ \% \leqq 1.5\%$$

The present invention further concerns itself, in the second aspect thereof, with high strength heat-resistant low alloy steels having a chemical composition of, on the weight basis, a carbon content of 0.03–0.12%, a silicon content not higher than 1%, a manganese content of 0.2–1%, a phosphor content not higher than 0.03%, a sulfur content not higher than 0.03%, a nickel content not higher than 0.8%, a chromium content of 0.7–3%, a molybdenum content of 0.3–1.5%, a vanadium content of 0.05–0.35%, a niobium content of 0.01–0.12%, a nitrogen content of 0.01–0.05% and, occasionally, a further content of one or more of wolfram, in a content of 0.5–2.4%, boron, in a content of 0.0005–0.015%, aluminum, in a content not higher than 0.05% and titanium, in a content of 0.05–0.2%, with the balance of iron and inevitable impurities, said low alloy steels being obtained by subjecting a starting metal having the above composition to a heat treatment by heating to a temperature above 1100° C. (A) and subsequent cooling to the ordinary temperature, then, subjecting the so treated metal to a plastic working at a temperature in the range from the ordinary temperature to a temperature at which no recrystallization occurs during the working or in the course of subsequent cooling and, finally, subjecting the so worked metal to a normalizing at a temperature lower than 1100° C. (A) and to a tempering at a temperature below the $Ac_1$ point.

The metal structure of the steels according to the present invention consists of ferrite plus bainite or of ferrite plus pearlite, in which the proportion of ferrite is greater as compared with that of conventional 1%–2¼% chromium steels. In the ferritic phase, a finely dispersed deposition of VN is present.

Below, the bases of limitation of content of each component element in the low alloy steels according to the first aspect of the present invention is explained. All the % values given are those on the weight basis.

(1) C:

C is present in the low alloy steels in a form of carbide with Cr, Mo, W, V and Nb and contributes to the increase in the creep strength. If, however, its content exceeds 0.12%, weld crack may be apt to occur and the creep strength becomes decreased. On the other hand, a carbon content of 0.03% or higher is required in order to increase the creep strength. If the carbon content is lower than 0.03%, the creep strength will be decreased. Thus, the carbon content should be limited to the range from 0.03 to 0.12%, wherein a preferred content may be in the range from 0.05–0.09%.

(2) Si:

Si serves as a deoxidizer and contributes also to an increase in the strength and in the fastness against oxidation. If, however, the content thereof exceeds 1%, the toughness of the alloy steels will be decreased and the creep strength thereof becomes also decreased. Thus, the Si content should be limited to be not higher than 1%, wherein a preferred Si content may be 0.2% or lower.

(3) Mn:

Mn serves, like Si, as a deoxidizer and improves the hardenability of the alloy steels. If the Mn content is short of 0.2%, such effect will not be revealed in a sensible degree. On the other hand, if it exceeds 1%, the alloy steels may become brittle. Therefore, the Mn content should be limited to the range from 0.2 to 1%, wherein a preferred content may be in the range from 0.4 to 0.6%.

(4) P and S:

These elements are present as contaminant elements and deteriorate toughness and other mechanical properties of the alloy steels. These elements should not be contained each in an amount greater than 0.03%, wherein it is preferable that P is not present in an amount greater than 0.01% and S is not present in an amount higher than 0.005%.

(5) Ni:

Ni improves the hardenability and increases the toughness of the alloy steels. If, however, its content exceeds 0.8%, the hardenability will become too high, resulting thus in a debasement of the weldability and also in a decrease in the creep rupture strength. Therefore, the Ni content should be limited to be not higher than 0.8%, wherein a preferred content may be 0.4% or lower.

(6) Cr:

Cr contributes to increase the resistance against oxidation as well as the creep rupture strength of the alloy steel by serving as a carbide-forming element, when existing in an adequate amount. However, if the content of Cr becomes more higher, the heat conductance of the alloy steels will rather be decreased with simultaneous decrease in the creep rupture strength. On the contrary however, if the Cr content is lower than 0.7%, the alloy steels may difficultly be employed at higher temperatures up to about 600° C. due to decrease in the resistance against oxidation and due to decrease in the creep rupture strength. Therefore, the Cr content should be limited to the range from 0.7 to 3%, wherein a preferred content may be in the range from 0.9 to 2.4%.

(7) Mo:

Mo will dissolve in the matrix metal and forms deposition of its carbide and so on to increase the creep rupture strength of the alloy steels. Such effect will be insufficient, if its content is short of 0.3%. Such effect will reach a saturation and the creep rupture strength of the alloy steels for longer creep rupture times may be decreased, if the Mo content exceeds 0.7%, when W is incorporated in combination with Mo, as explained afterwards. Therefore, the Mo content should be limited to the range from 0.3 to 0.7%, wherein a high and at the most stable rupture strength will be attained if its content in relation to the W content meets the following condition:

$$0.8\% \leqq (Mo + \tfrac{1}{2} W)\ \% \leqq 1.5\%$$

(8) W:

W contributes, like Mo, to increase the creep rupture strength by being dissolved in the matrix metal. In case the Mo content is 0.3–0.7%, the above effect of W content will not be sufficient at its content not higher than 0.6% and the hot workability and the toughness of the alloy steels become decreased at contents higher than 2.4%. Thus, a high and most stable creep rupture strength will be achieved, when the W content and the Mo content meet the following condition:

$$0.8\% \leqq (Mo + \tfrac{1}{2} W)\ \% \leqq 1.5\%$$

(9) V:

V will form carbide and combine to N to form VN dispersed in the ferrite matrix, resulting thus in a considerable increase in the creep rupture strength. This effect appears in a V content of 0.05% or higher. If, however, the V content exceeds 0.35%, the susceptibility to occurrence of weld crack is increased and the weldability becomes deteriorated. Therefore, the V content should be limited to the range from 0.05 to 0.35%, wherein a preferred content may be in the range from 0.15–0.3%.

(10) Nb:

Nb contributes to increase the creep rupture strength of the alloy steels for shorter creep rupture times by formation of its carbonitride and reveals, in combination with the V content, an effect of forming deposition of the carbonitride finely dispersed within the matrix metal. Such effect appears at a Nb content over 0.01%. Such effect will reach a saturation when exceeding 0.12% and cause even a decrease in the creep rupture strength for longer creep rupture times. A large content of Nb may also result in decrease in the weldability. Therefore, the Nb content should be limited to the range from 0.01 to 0.12%, wherein the preferred range may be from 0.01 to 0.05%.

(11) N:

N plays a role as an alternative element for carbon so as to form nitrides and carbonitrides with V, Nb and so on, resulting in a marked increase in the creep rupture strength. Such effect will not be revealed sufficiently at its content not higher than 0.01%. However, an N content exceeding 0.05% will result in an increase in the quenching hardenability to deteriorate the weldability. Therefore, the N content should be limited to the range from 0.01–0.05%, wherein a preferred content may be in the range from 0.01–0.03%.

As explained above, the essential feature of the present invention resides in the point that an optimization of the contents of Mo and W is attained in order to increase the creep rupture strength for longer creep rupture times. Thus, the Mo content and the W content are limited in the range from 0.3–0.7% by weight and 0.6%–2.4% by weight respectively and should meet the condition of $0.8\ wt.\text{-}\% \leqq (Mo + \tfrac{1}{2} W)\ wt.\text{-}\% \leqq 1.5\ wt.\text{-}\%$. This condition is well illustrated in the appended FIG. 1, in which the range of Mo content and W content to be limited according to the present invention is indicated by the hatched area.

In the past, for combined incorporation of Mo with W, it had been a common practice to employ a larger Mo content than W content. This had resulted in a insufficient solid solution strength and, in particular, the creep rupture strength for longer creep rupture times had been insufficient. According to the present invention, it has been discovered that a further increase in the strength due to facilitated dissolution in the solid solution is attained and a contribution to realizing stable creep rupture strength for longer creep rupture times will be brought about by modifying the mode of deposition of carbonitrides when W content is chosen to be higher than Mo content.

Now, the present invention will further be explained by the experimental results for the properties of alloy steels according to the present invention in comparison with those of conventional alloy steels. The chemical compositions of alloy steels used are recited in Table 1.

TABLE 1

Chemical Composition of Alloy Steels Employed

| Element | Steels of the Invention | | | | | | | | | Conventional Steels | |
|---|---|---|---|---|---|---|---|---|---|---|---|
| | a | b | c | d | e | f | g | h | i | j | k |
| C | 0.08 | 0.07 | 0.06 | 0.07 | 0.07 | 0.09 | 0.05 | 0.09 | 0.05 | 0.07 | 0.08 |
| Si | 0.47 | 0.46 | 0.30 | 0.41 | 0.51 | 0.43 | 0.37 | 0.61 | 0.52 | 0.42 | 0.34 |
| Mn | 0.61 | 0.70 | 0.64 | 0.62 | 0.57 | 0.51 | 0.54 | 0.61 | 0.63 | 0.60 | 0.64 |
| P | 0.016 | 0.017 | 0.018 | 0.018 | 0.015 | 0.017 | 0.020 | 0.016 | 0.018 | 0.020 | 0.019 |
| S | 0.003 | 0.003 | 0.004 | 0.005 | 0.004 | 0.003 | 0.003 | 0.005 | 0.006 | 0.003 | 0.006 |
| Ni | 0.21 | 0.21 | 0.19 | 0.20 | 0.16 | 0.21 | 0.17 | 0.19 | 0.18 | 0.30 | 0.18 |
| Cr | 2.12 | 2.34 | 2.01 | 2.18 | 2.95 | 1.54 | 1.55 | 1.75 | 1.95 | 2.12 | 2.02 |
| Mo | 0.51 | 0.69 | 0.32 | 0.49 | 0.31 | 0.48 | 0.69 | 0.32 | 0.30 | 0.59 | 0.30 |
| V | 0.20 | 0.25 | 0.22 | 0.24 | 0.27 | 0.31 | 0.25 | 0.33 | 0.27 | 0.25 | 0.24 |
| N | 0.014 | 0.025 | 0.047 | 0.045 | 0.037 | 0.034 | 0.018 | 0.020 | 0.023 | 0.019 | 0.020 |
| Nb | 0.04 | 0.06 | 0.04 | 0.05 | 0.01 | 0.09 | 0.07 | 0.08 | 0.01 | 0.04 | 0.05 |
| W | 0.65 | 0.61 | 0.99 | 1.00 | 1.49 | 1.48 | 1.48 | 2.00 | 2.39 | 0.50 | 0.61 |
| B | — | — | 0.001 | — | — | — | 0.005 | — | — | — | — |
| Al | — | — | — | — | 0.03 | — | 0.02 | — | — | — | — |
| Ti | — | — | 0.11 | — | — | 0.18 | 0.12 | — | — | — | — |

| Element | Conventional Steels | | | | | | | | | | |
|---|---|---|---|---|---|---|---|---|---|---|---|
| | l | m | n | o | p | q | r | s | t | u | v |
| C | 0.08 | 0.09 | 0.06 | 0.07 | 0.08 | 0.08 | 0.09 | 0.07 | 0.08 | 0.08 | 0.07 |
| Si | 0.51 | 0.47 | 0.46 | 0.44 | 0.51 | 0.51 | 0.47 | 0.49 | 0.50 | 0.47 | 0.42 |
| Mn | 0.54 | 0.47 | 0.61 | 0.62 | 0.60 | 0.57 | 0.56 | 0.54 | 0.63 | 0.52 | 0.54 |
| P | 0.018 | 0.017 | 0.017 | 0.017 | 0.018 | 0.018 | 0.016 | 0.021 | 0.018 | 0.019 | 0.019 |
| S | 0.005 | 0.004 | 0.005 | 0.005 | 0.004 | 0.004 | 0.003 | 0.005 | 0.006 | 0.006 | 0.004 |
| Ni | 0.19 | 0.17 | 0.20 | 0.21 | 0.22 | 0.19 | 0.19 | 0.23 | 0.21 | 0.20 | 0.17 |
| Cr | 1.97 | 1.98 | 2.14 | 1.81 | 2.02 | 2.14 | 2.02 | 2.43 | 1.95 | 1.94 | 1.76 |

TABLE 1-continued

| Chemical Composition of Alloy Steels Employed | | | | | | | | | | | |
|---|---|---|---|---|---|---|---|---|---|---|---|
| Mo | 0.30 | 0.91 | 1.01 | 0.96 | 1.01 | 1.02 | 1.00 | 0.19 | 0.62 | 1.00 | 0.61 |
| V | 0.27 | 0.26 | 0.26 | 0.29 | 0.31 | 0.28 | 0.25 | 0.26 | 0.30 | 0.34 | 0.28 |
| N | 0.014 | 0.032 | 0.026 | 0.021 | 0.021 | 0.023 | 0.018 | 0.024 | 0.035 | 0.030 | 0.031 |
| Nb | 0.05 | 0.06 | 0.05 | 0.06 | 0.08 | 0.03 | 0.05 | 0.06 | 0.05 | 0.04 | 0.03 |
| W | 0.80 | 0.78 | 0.90 | 0.97 | 1.01 | 1.22 | 1.51 | 1.98 | 2.01 | 2.00 | 2.41 |
| B | — | — | — | 0.007 | — | — | 0.008 | — | — | — | — |
| Al | — | — | — | — | — | — | 0.02 | — | 0.01 | — | — |
| Ti | — | — | — | 0.11 | — | — | 0.10 | — | — | — | — |

Each of the alloy steels employed for the experiment was prepared by melting 50 kg of the respective starting charge in a high-frequency melting furnace under atmospheric conditions and subjecting the resulting alloy steel to a hot forging at a temperature in the range of 950°-1100° C. to shape into a rod having a sectional dimension of 40×20 mm.

Heat treatment of the rod was carried out at 1050° C.AC+750° C.AC. From the hot forged rod, test specimens were cut in a direction parallel to the forging direction, which were subjected to creep rupture strength test at 600° C.

Figure 2:
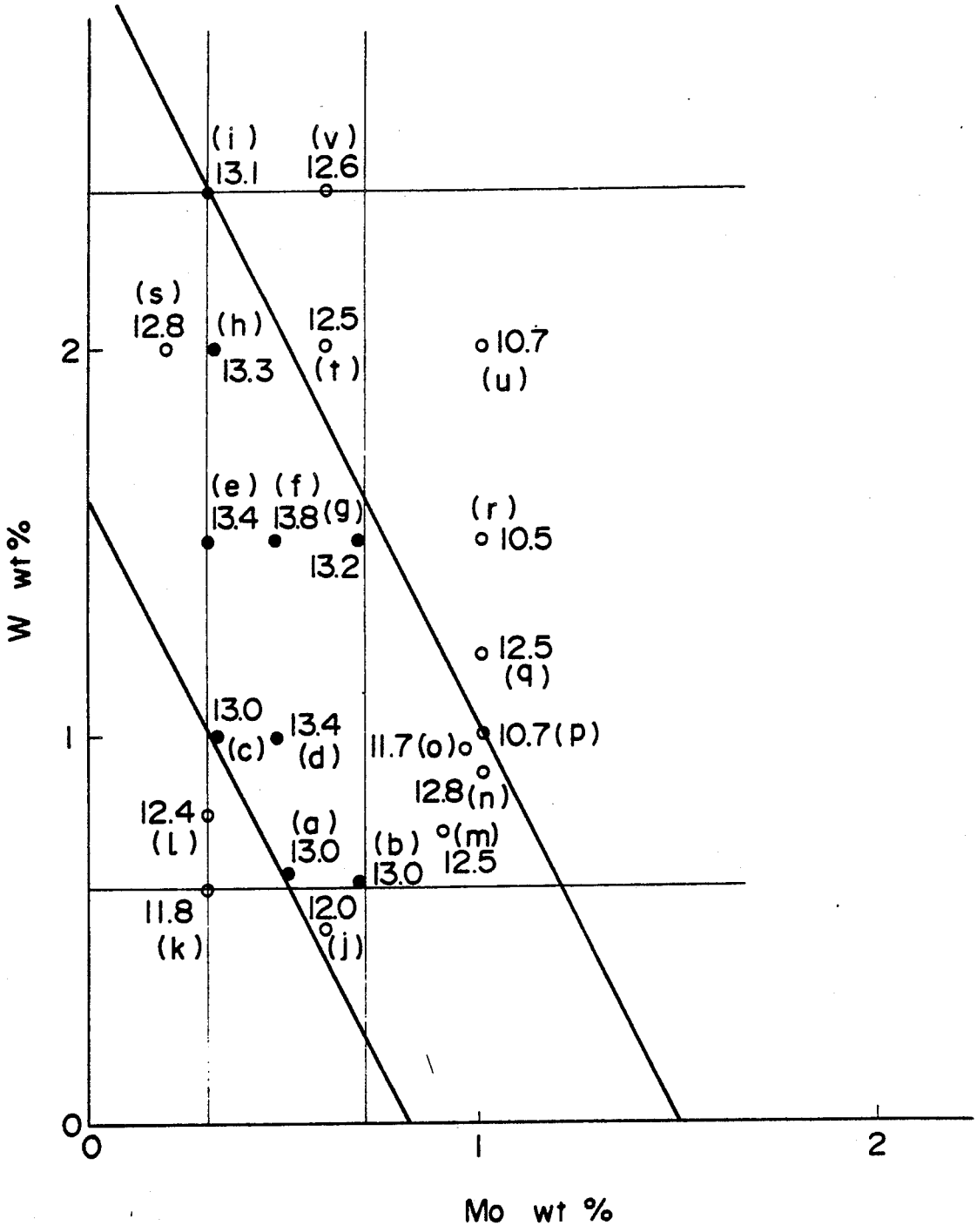
FIG. 2 shows actual distribution of W- and Mo-contents of the low alloy steels according to the first aspect of the present invention to be limited for attaining the contemplated level of creep rupture strength (at 600° C., $10^4$ hours) in the W and Mo composition diagram of FIG. 1.

The 600° C. creep rupture strength of the specimen was determined by extrapolating the test results obtained for creep rupture testing times up to 8000 hours to the point of $10^4$ hours. In FIG. 2, the $10^4$ hr creep rupture strength at 600° C. in kgf/mm$^2$ determined for each steel sample is indicated by the numeral beside each plot. It is seen from FIG. 2 that all the creep rupture strength values inside the range prescribed according to the present invention are greater than 13 kgf/mm$^2$, whereas those in outside of the range according to the present invention showed values lower than 13 kgf/mm$^2$.

Figure 3:
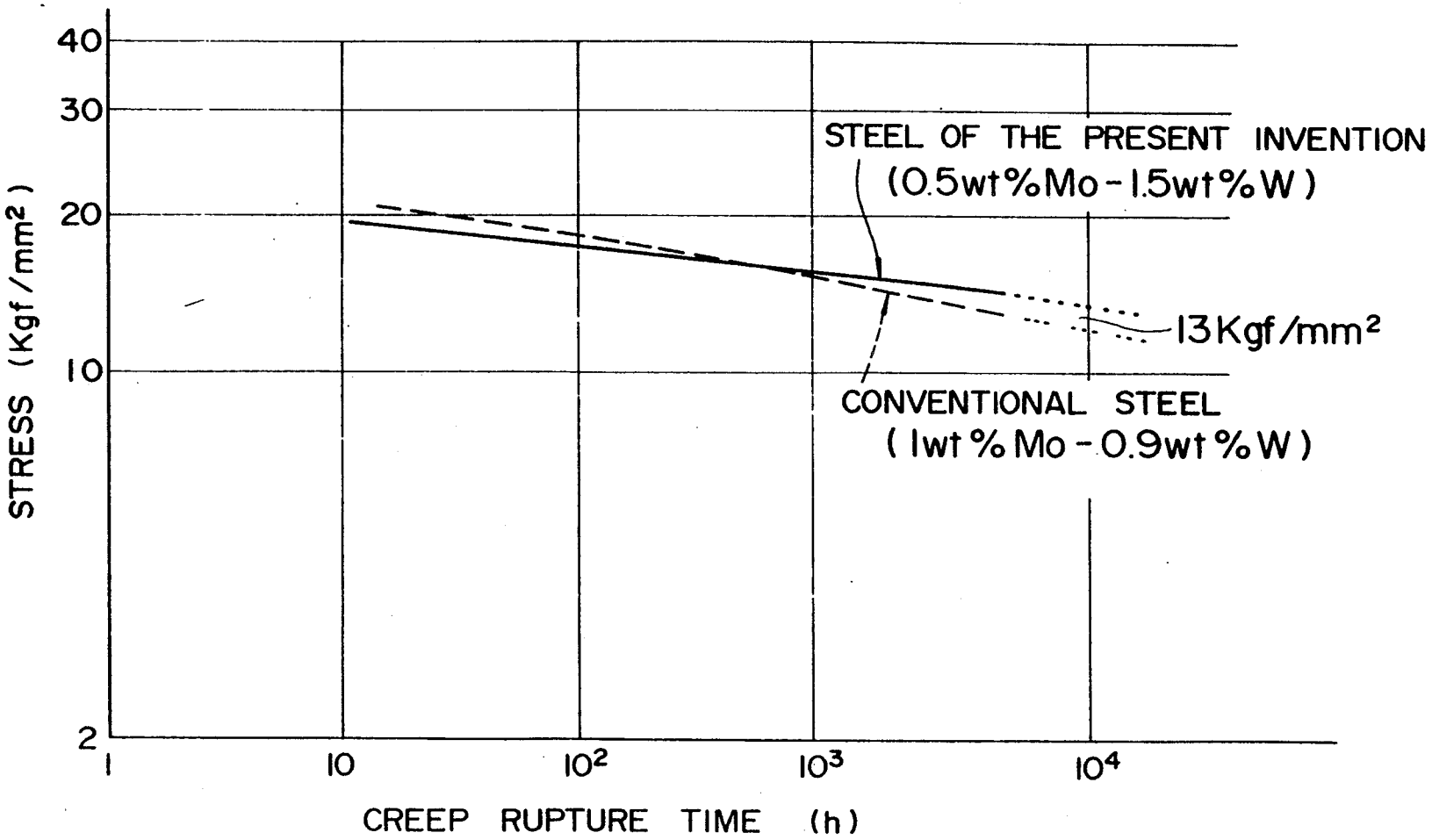
FIG. 3 is a graph showing the course of variation of the creep rupture time depending on the stress for a low alloy steel according to the first aspect of the present invention in comparison with that for a conventional steel having the same chemical composition (dotted line)

FIG. 3 shows creep rupture time-stress curves for typical steel samples of the present invention and of the stand of the technique. As is clear from this diagram, conventional steels having a relatively larger amount of molybdenum exhibited higher creep rupture strengths for shorter creep rupture times below several hundred hours as compared with those of the steels according to the present invention, whereas the strength value at $10^4$ hr of the conventional steels was lower than that of the steels according to the present invention, since the inclination of the curve is greater for the conventional steels than that for the steels according to the present invention. It was thus confirmed that the steels according to the present invention reveal higher creep rupture performances stable also for longer creep rupture times.

As is made clear from the above experimental results, high strength heat-resistant low alloy steels have thus been provided according to the present invention, which reveal higher creep rupture strength stable in longer creep rupture times than the conventional high strength heat-resistant low alloy steels.

Now, the description will be directed to the second aspect of the present invention.

Below, the bases for each limitation of content of the component element of the steels according to the second aspect of the present invention are explained in a similar way as in the first aspect of the present invention. Here, recitation of explanation is omitted, so far as the basis of limitation is the same as in the first aspect of the present invention. Here also, % values given are on the weight basis.

(1) Mo:

Mo will dissolve in the matrix metal and forms deposition of its carbide or so on to increase the creep rupture strength of the alloy steels. Such effect will be insufficient, if its content is short of 0.3%. Such effect will reach a saturation and even a decrease in the toughness may be caused, when Mo content exceeds 1.5%. A higher content of Mo may cause deterioration of hot workability of the alloy steels. Therefore, the Mo content should be limited to the range from 0.3 to 1.5%, wherein a preferable content may be in the range from 0.7 to 1.3%.

(2) W:

W content permits to decrease the amount of Mo content and it dissolves together with Mo into the ferrite matrix to thereby result in considerable increase in the high temperature strength. The above effect of W content will not be sufficient when it is short of 0.5%. However, the hot workability and the toughness of the alloy steels become decreased when the W content exceeds 2.4%. Therefore the W content should be limited to the range from 0.5 to 2.4%, wherein the preferred range may be 0.7-1.8%

(12) B:

B increases the strength of grain boundary and increases the creep rupture strength and ductility of the alloy steels. The above effect will not be sufficient when B content is short of 0.0005%. However, the hot workability of the alloy steels becomes decreased when it exceeds 0.015%. Therefore the B content in the alloy steels should be limited to the range from 0.0005 to 0.015%, wherein the preferred range may be 0.001-0.005%.

(13) Al:

Al is effective as a deoxidizer and reveals an effect of increasing the low temperature toughness of the alloy steels. If, however, its content exceeds 0.05%, a reduction in the crystal grain size will be caused with decrease in the creep rupture strength. Therefore, the Al content should be limited to not higher than 0.05%, wherein a preferred content may be 0.015% or lower.

(14) Ti:

Ti forms carbide and contributes to an increase in the creep rupture strength of the alloy steels. Such effect will not be sufficient when Ti content is short of 0.05%. However, a Ti content higher than 0.2% will cause a decrease in the low temperature toughness of the alloy steels. Therefore the Ti content in the alloy steels should be limited to the range from 0.05 to 0.2%, wherein the preferred range may be 0.05-0.1%.

Elements W, B, Al and Ti bring about an effect of stabilizing the ferrite phase in the alloy steels according to the second aspect of the present invention, by facilitating deposition of the strengthening compound VN in the ferrite phase to facilitate indirectly the increase in the high temperature strength (creep rupture strength). In the alloy steels according to the second aspect of the present invention, at least one of the elements W, B, Al and Ti is incorporated within the prescribed range explained above.

Below, the heat treatment conditions for the alloy steels according to the present invention are described.

By heating the steel having the composition described above to a temperature of 1100° C. or higher, especially the solution of niobium is facilitated and the most part of niobium introduced is dissolved in the matrix metal. Then, the so heat treated alloy is subjected to a plastic working at a temperature within the range from the ordinary temperature to such a temperature that no recrystallization during the working or in the course of cooling thereof occurs, namely a temperature nearly the $Ac_1$ point (about 750° C.), in order to ease the recrystallization at the temperature of the subsequent normalizing.

By choosing the normalizing temperature to be lower than the above temperature of 1100° C.(A), an amount of dissolved Nb which corresponds to the solubility difference between 1100° C. and the so chosen nomalizing temperature will be caused to deposit in a form of finely dispersed particles of NbC. The so deposited finely dispersed NbC will counteract to the formation of coarse crystal grains during the recrystallization at the normalizing temperature and favors the sufficiently fine dispersion of austenitic crystal grains to improve the toughness of the alloy steels. If the heat treatment temperature is not higher than 1100° C.(A), the amount of Nb dissolved in the matrix metal will not be sufficiently high. In addition, normalizing is effected in general at a temperature not higher than 1100° C.(A) by taking into account of the contemplated resultant high-temperature strength and toughness of the alloy steels, so that it is necessary to subject the alloy steel to a heating treatment at a temperature of 1100° C.(A) or higher, in order to attain a finely dispersed deposition of NbC by the difference in the solubility of NbC. From these reasons, the temperature of the intermediate heat treatment befere the plastic working should be shosen at 1100° C.(A) or higher.

Below, the effect of the present invention will be described by way of Examples of the second aspect of the present invention.

5 batches of each 50 kg charge for the corresponding five sample alloy steels of the chemical compositions given in Table 2 were melted in a high frequency melting furnace under atmospheric condition. From the resulting alloy steels, rods each having a sectional dimension of 40×20 mm was prepared by hot forging at a temperature of 950°-1100° C.

Some of these rods were worked into plates each having a dimension of 60×15 mm by first heating them to a temperature of 1150° C. for 1 hour, followed by cold rolling. These plates were subjected to heat treatment together with the remaining rods of 40×20 mm by normalizing at a temperature of 1050° C. for 1 hour and subsequent tempering at 750° C. for 1 hour.

Thus, the working conditions of the alloy steels according to the present invention consist of a hot forging at a temperature in the range from 950° C.-1100° C., a subsequent intermediate heating treatment at 1150° C. for 1 hour, a cold rolling, a normalizing at a temperature of 1050° C. for 1 hour and a tempering at 750° C. for 1 hour, in contrast to the ordinary working conditions for conventional alloy steels consisting of a hot forging at a temperature in the range of 950°-1100° C., a normalizing at a temperature of 1050° C. for 1 hour and a tempering at 750° C. for 1 hour.

TABLE 2

| Element | Composition of Test Alloy Steels of the Invention — Charge No. for Test Alloy Steels 1 | 2 | 3 | 4 | 5 |
|---|---|---|---|---|---|
| C | 0.06 | 0.11 | 0.07 | 0.07 | 0.09 |
| Si | 0.19 | 0.24 | 0.32 | 0.25 | 0.21 |
| Mn | 0.38 | 0.54 | 0.45 | 0.41 | 0.40 |
| P | 0.020 | 0.021 | 0.028 | 0.017 | 0.016 |
| S | 0.004 | 0.003 | 0.006 | 0.005 | 0.004 |
| Ni | 0.14 | 0.40 | 0.75 | 0.11 | 0.19 |
| Cr | 1.81 | 1.75 | 1.94 | 2.20 | 1.95 |
| Mo | 0.85 | 1.05 | 0.94 | 1.01 | 0.99 |
| V | 0.29 | 0.33 | 0.34 | 0.24 | 0.21 |
| Nb | 0.04 | 0.06 | 0.05 | 0.01 | 0.02 |
| N | 0.019 | 0.013 | 0.047 | 0.027 | 0.034 |
| W | — | — | — | 1.02 | 1.21 |
| B | — | — | — | 0.005 | 0.009 |
| Al | — | — | — | — | 0.04 |

Several alloy steels according to the present invention and conventional alloy steels each having the same chemical composition as the corresponding alloy steel according to the present invention but prepared under different conditions from those for the alloy steels of the present invention were tested for Charpy impact value and for creep rupture strength. In addition, a welded joint was prepared from these alloy steels in order to examine occurrence of local softening around the welded portion by the influence of the welding heat.

The test results for the Charpy energy absorption at 0° C. and for the creep rupture strength of alloy steels according to the present invention and of conventional alloy steels are recited in Table 3. It is clear from Table 3, that the alloy steels according to the present invention have considerably improved toughness and the creep rupture strength thereof is also confirmed to be sufficiently high.

TABLE 3

| Steel Charge No. | Comparison of Properties of the Steels of the Invention and of Prior Art — Steel of Prior Art: 0° C. Charpy Energy Absorp.* | 600° C. Creep Rupt. Strength (kgf/mm²) $10^3$ hr | $10^4$ hr | Steel of the Invention: 0° C. Charpy Energy Absorp.* | 600° C. Creep Rupt. Strength (kfg/mm²) $10^3$ hr | $10^4$ hr |
|---|---|---|---|---|---|---|
| 1 | 7.7 | 16.5 | 13.0 | 26.2 | 15.8 | 12.5 |
| 2 | 6.0 | 16.5 | 12.5 | 25.4 | 16.1 | 12.6 |
| 3 | 7.6 | 11.8 | 8.5 | 27.3 | 12.0 | 9.1 |
| 4 | 6.2 | 14.0 | 10.7 | 28.1 | 13.8 | 10.6 |
| 5 | 7.2 | 15.5 | 12.5 | 24.8 | 16.0 | 12.7 |

Note:
*Value in kgf · m

Figure 4:
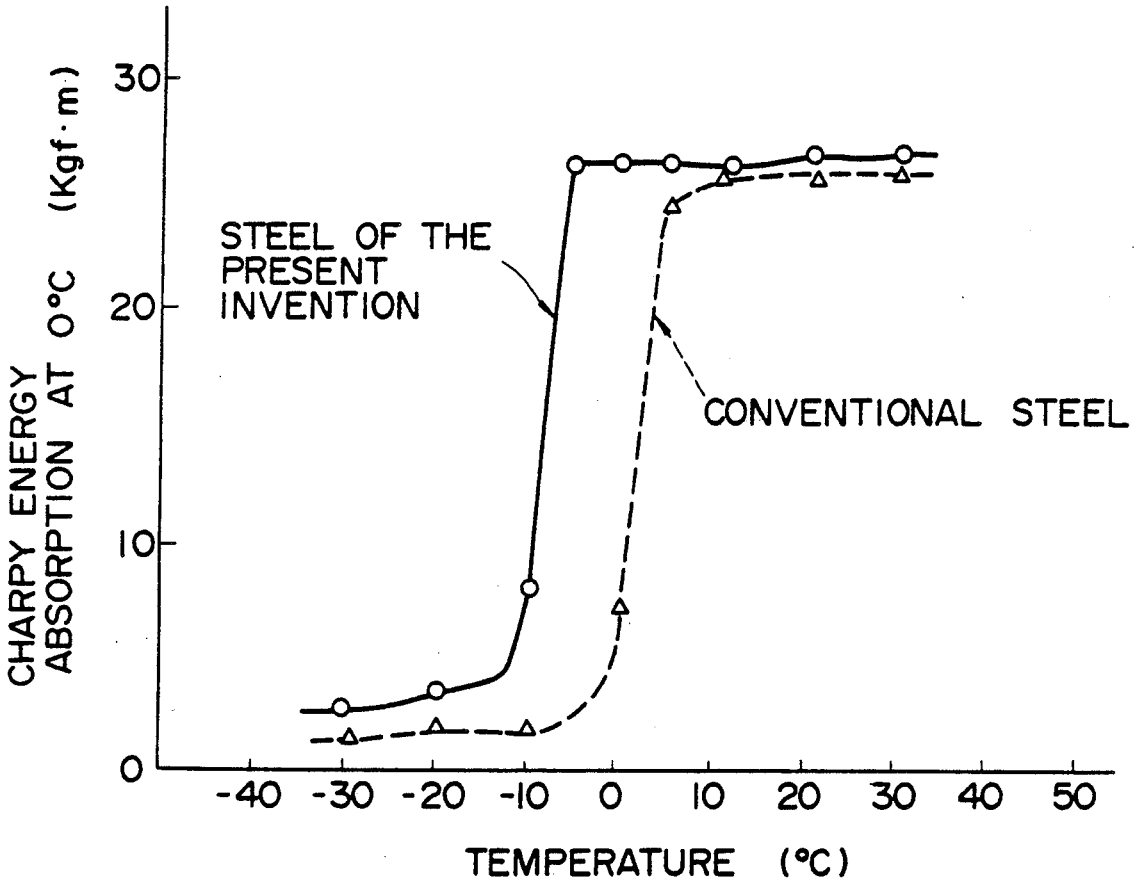
FIG. 4 is a graph of the Charpy energy absorption-temperature curve for a low alloy steel according to the second aspect of the present invention shown in comparison with that for a conventional steel having the same chemical composition (dashed line)

FIG. 4 illustrates the transition curves for the Charpy energy absorption observed for typical alloy steels of the present invention and of the prior art (namely, the steels of each No. 1 charge as given in Table 2). As is seen, the transition temperature for the alloy steel according to the present invention is shifted to lower side from that of the conventional alloy steel due to the fine distribution of the original austenitic crystal grains, showing a considerable improvement in the toughness.

Figure 5:
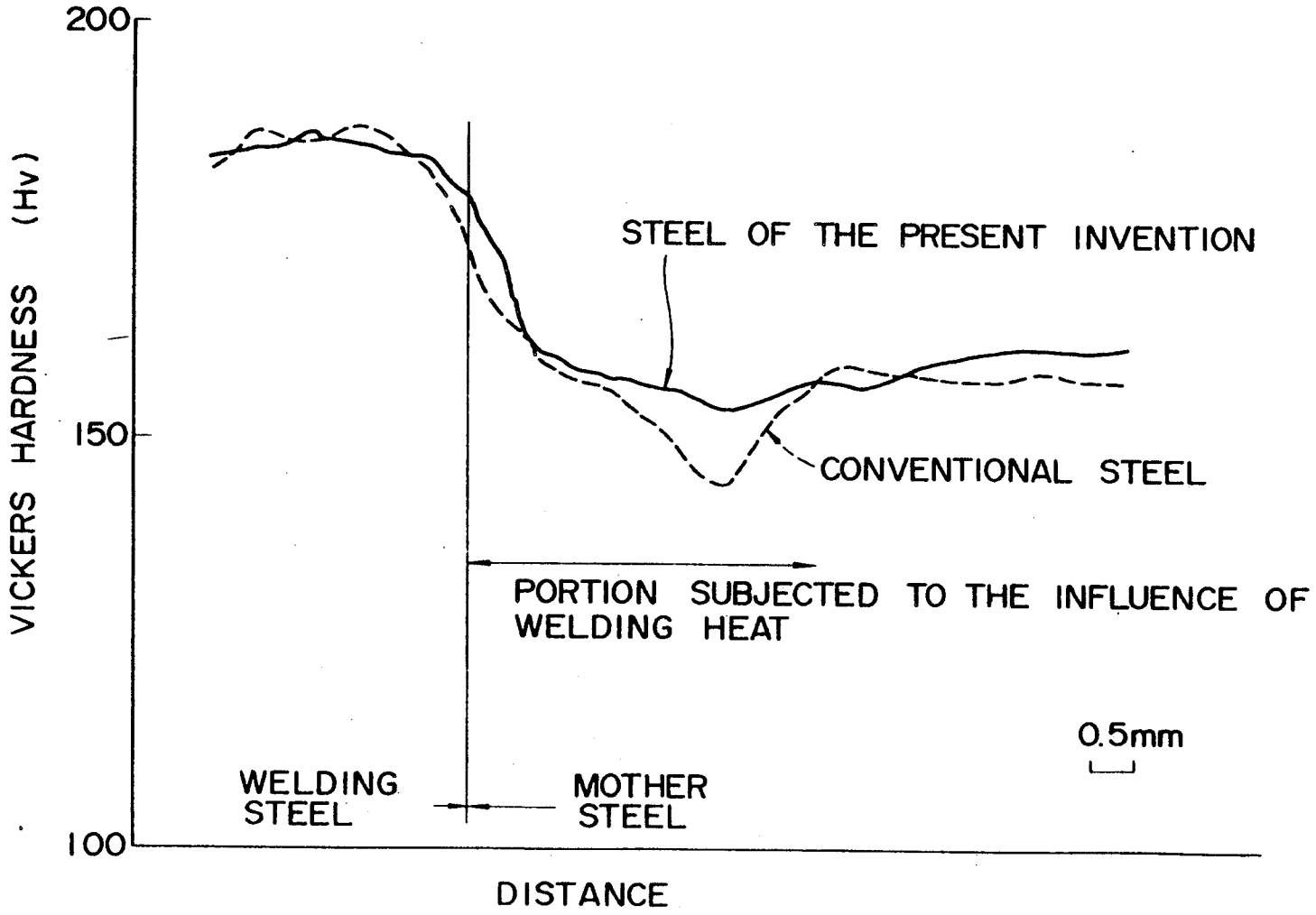
FIG. 5 is a graphic illustration of variation in the observed local Vickers hardness across a welded portion for a low alloy steel according to the present invention shown in comparison with that for a conventional steel having the same chemical composition (dashed line).

In FIG. 5, distribution of local hardness across a welded portion observed for the welded joint mentioned previously is shown in comparison for the alloy steels of each No. 1 charge mentioned above. As seen, a softened region is recognized in the fine grain range of the portion subjected to the influence of welding heat for the conventional alloy steel, whereas scarce difference in the hardness is found for the steel according to the present invention. This may be due to the fact that a softening will occur in the alloy steel according to the present invention with difficulty, since austenitic crystal grains are present per se as fine particles and since the deposited NbC exists as a stable dispersion of fine particles.

The crystal grain size (according to ASTM) of the austenite crystals was found to be 3.2 for the conventional alloy steel and 8.5 for the alloy steel according to the present invention. It was thus confirmed that the alloy steels according to the present invention have superior creep rupture strength and considerably improved toughness with simultaneous attainment of prevention of occurrence of softened regions in the portion subjected to the influence of welding heat.

In the alloy steels according to the present invention, the disadvantages of conventional alloy steels, such as, austenite steels, 9% chromium steels, 12% chromium steels, 1%–2¼% chromium steels and steels containing less than 1% chromium have been eliminated and, in addition, occurrence of a softened portion around a welded portion is prevented, with simultaneous attainment of improvement of Charpy impact value of the matrix metal. Thus, according to the present invention, alloy steels capable of employing in the place of austenite stainless steels or high strength 9% chromium and 12% chromium steels for applications at temperatures up to about 600° C. are provided.

We claim:

1. High strength heat-resistant low alloy steels comprising a chemical composition of, on the weight basis, a carbon content of 0.03–0.12%, a silicon content not higher than 1%, a manganese content of 0.2–1%, a phosphorous content not higher than 0.03%, a sulfur content not higher than 0.03%, a nickel content not higher than 0.8%, a chromium content of 0.7–3%, a molybdenum content of 0.3–0.7%, a tungsten content of 0.6–2.4%, a vanadium content of 0.05–0.35%, a niobium content of 0.01–0.12% and a nitrogen content of being 0.01–0.05% with the balance of iron and inevitable impurities, wherein the molybdenum content and the tungsten content satisfy the relationship:

$$0.8\% \leqq (Mo + \tfrac{1}{2}W)\ \% \leqq 1.5\%$$

2. High strength heat-resistance low alloy steels comprising a chemical composition of, on the weight basis, a carbon content of 0.03–0.12%, a silicon content not higher than 1%, a manganese content of 0.2–1%, a phosphorous content not higher than 0.03%, a sulfur content not higher than 0.03%, a nickel content not higher than 0.8%, a chromium content of 0.7–3%, a molybdenum content of 0.3–1.5%, a vanadium content of 0.05–0.35%, a niobium content of 0.01–0.12%, a nitrogen content of 0.01–0.05% and, occasionally, a further content of at least one of tungsten, in a content of 0.5–2.4%, boron, in a content of 0.0005–0.015%, aluminum, in a content not higher than 0.05%, and titanium, in a content of 0.05–0.2%, with the balance being iron and inevitable impurities, said low alloy steels being made by the process comprising subjecting a starting metal having the above chemical composition to a heat treatment by heating to a temperature above 1100° C.(A), cooling said starting metal to ordinary temperature, subjecting the so treated metal to plastic working at a temperature in the range from the ordinary temperature to a temperature at which no recrystallization occurs during one of the plastic working and subsequent cooling and, subjecting the so worked metal to a normalizing at a temperature lower than 1100° C.(A) and to tempering at a temperature below the $Ac_1$ point.

* * * * *